US005233854A

United States Patent [19]

Bowman et al.

[11] Patent Number: 5,233,854

[45] Date of Patent: Aug. 10, 1993

[54] PRESS APPARATUS FOR HYDROFORMING A TUBE

[75] Inventors: Merle G. Bowman, Swartz Creek; Van Keith Seymore, Sr., Davison; David T. Boyd, Sterling Heights, all of Mich.

[73] Assignee: General Motors Corporation, Detroit, Mich.

[21] Appl. No.: 881,275

[22] Filed: May 11, 1992

[51] Int. Cl.[5] ..... B21D 9/15; B21D 26/02

[52] U.S. Cl. ..... 72/58; 72/62; 29/421.1

[58] Field of Search ..... 72/57, 58, 59, 61, 62; 29/421.1

[56] References Cited

U.S. PATENT DOCUMENTS

| | | | |
|---|---|---|---|
| 4,317,348 | 3/1982 | Halene et al. | 72/58 |
| 4,470,287 | 9/1984 | Antonov et al. | 72/57 |
| 4,580,427 | 4/1986 | Akamatsu | 72/58 |

FOREIGN PATENT DOCUMENTS

| | | | |
|---|---|---|---|
| 0001357 | 1/1976 | Japan | 72/58 |
| 0220929 | 9/1988 | Japan | 72/58 |
| 0385146 | 3/1965 | Switzerland | 72/57 |

*Primary Examiner*—David Jones
*Attorney, Agent, or Firm*—Charles E. Leahy

[57] ABSTRACT

An upper die mounted on the upper bed of the press and a lower die mounted on the lower bed of the press mate with one another upon lowering of the upper bed. A mounting plate is spring mounted on the lower bed adjacent the lower die to enable vertical movement of the mounting plate. A seal unit to seal with the end of the tube accessible through an open end in the dies. The seal unit is mounted on the mounting plate for horizontal reciprocating movement between a retracted position withdrawn away from the tube and an engaged position in sealing engagement with the tube. A pusher carried on the upper bed engages with the seal unit upon lowering of the upper bed to push the seal unit vertically against the spring effort of the mounting plate to obtain sealing alignment of the seal unit with the tube. In addition, a heel unit carried on the upper bed is lowered with the upper bed into a position blocking the seal unit against horizontal movement in the direction away from sealing engagement with the tube so that the application of hydroforming pressure through the seal and into the tube cannot cause the seal unit to become ejected from the tube. In addition, a lower clamp is mounted on the spring mounted plate and an upper clamp is spring mounted on the upper bed so that lowering of the upper bed causes the upper and lower clamps tightly grip the tube.

5 Claims, 5 Drawing Sheets

PRESS APPARATUS FOR HYDROFORMING A TUBE

The invention relates to hydroforming of a tube in a die by the application of hydraulic pressure to the interior of the tube and more particularly provides an improved press apparatus for loading the tube in the die and sealing the tube.

BACKGROUND OF THE INVENTION

It is well known in the prior art that a tube may be hydroformed to a desired complex tubular shape. The tube is placed between a pair of dies having cavities which define the desired resultant shape of the tube. The ends of the tube are accessible through the die and a seal is connected to the ends of the tube so that pressurized fluid injected into the tube forces the tube to expand and conform to the shape defined by the die cavity. It is also known to mount the dies in a press so that a lower die is stationary on the lower bed of the press and the upper die moves up and down with the upper bed of the press to permit loading and unloading of the tubes from the die.

In order to economically manufacture hydroformed tubes, it would be desirable to provided improvements in the press apparatus by which the tube would be properly held between the dies so that the upper die can be lowered into engagement with the lower die to capture the tube in the cavity defined between the dies. It also is desirable to provide apparatus for mounting the seal on the lower bed of the press in a manner which would facilitate the sealing engagement and subsequent disengagement of the seal from the ends of the tube. Furthermore, it would be desirable to provide effective mechanism for retaining the seal unit in sealing engagement with the ends of the tube against the affects of the high pressure hydraulic fluid acting on the seal in the direction to disengage the seal from the end of the tube.

SUMMARY OF THE INVENTION

According to the invention, an upper die mounted on the upper bed of the press and a lower die mounted on the lower bed of the press are adapted to mate with one another upon the lowering of the upper bed to define a cavity capturing the tube between the dies. A mounting plate is spring mounted on the lower bed adjacent the lower die to enable vertical movement of the mounting plate relative to the lower bed and the lower die. A seal unit carries a seal which is adapted to seal with the end of the tube accessible through an open end in the dies. The seal unit is mounted on the mounting plate for horizontal reciprocating movement between a retracted position withdrawn away from the tube and an engaged position in which the seal unit is moved horizontally into sealing engagement with the tube. A pusher is carried on the upper bed of the press and engages with the seal unit upon lowering of the upper bed to push the seal unit vertically against the spring effort of the mounting plate to obtain and maintain a sealing alignment of the seal unit with the tube. In addition, a heel unit carried on the upper bed is lowered with the upper bed into a position blocking the seal unit against horizontal movement in the direction away from sealing engagement with the tube so that the application of hydroforming pressure through the seal and into the tube cannot cause the seal unit to become ejected from the tube. In addition, a lower clamp is mounted on the spring mounted plate to preposition the tube at a vertical position aligned with the seal unit and an upper clamp is spring mounted on the upper bed so that lowering of the upper bed toward the lower bed carries the upper clamp into engagement with the tube and the upper and lower clamps tightly grip the tube.

DESCRIPTION OF THE DRAWINGS

These and other objects, features, and advantages will better understood upon consideration of the description of the preferred embodiment, and the appended drawings in which.

DESCRIPTION OF THE PREFERRED EMBODIMENT

Figure 1:
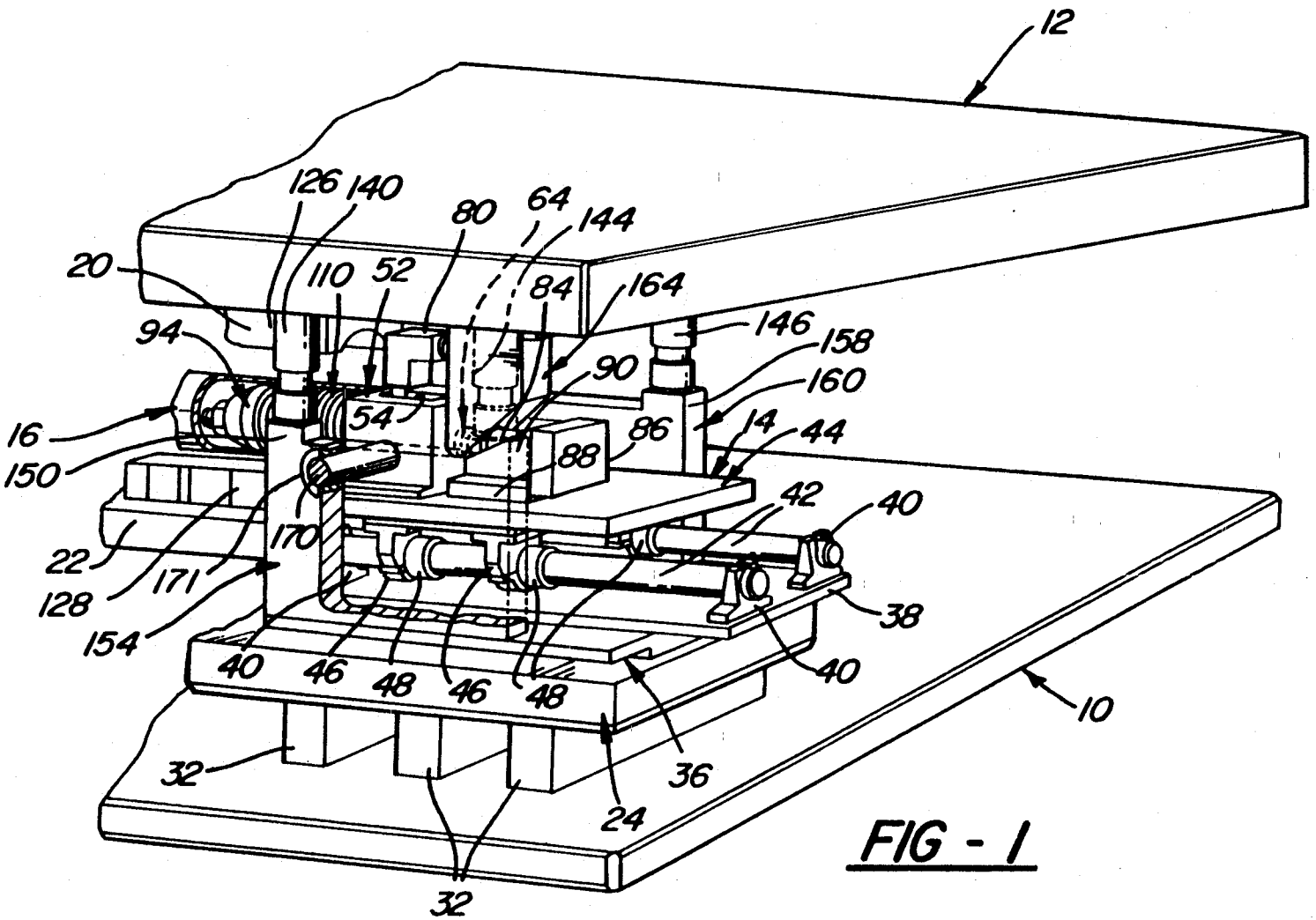
FIG. 1 :s a perspective view of the press apparatus showing the seal engaged with the end of the tube and the upper bed having been lowered somewhat toward the lower bed from its fully raised position.

Referring now particularly to FIG. 1 of the drawings, a conventional press includes a lower bed or base 10 and an upper bed 12. As is customary, the lower bed 10 is stationary and the upper bed 12 moves vertically relative to the bed 10. A seal unit 14 is mounted on the press bed 10 as will be described. A tube 16 which is to be hydroformed has one of its end portions 18 sealed by the seal unit 14. The other end portion of the tube, not shown, is plugged. Once the end portions of the tube are sealed, pressurized fluid from a conventional source is injected into the tube 16 to conform the tube to the shape of an upper die 20 and a lower die 22 which are closed around the tube as is shown in FIG. 2.

Seal Unit Mounting

Figure 2:
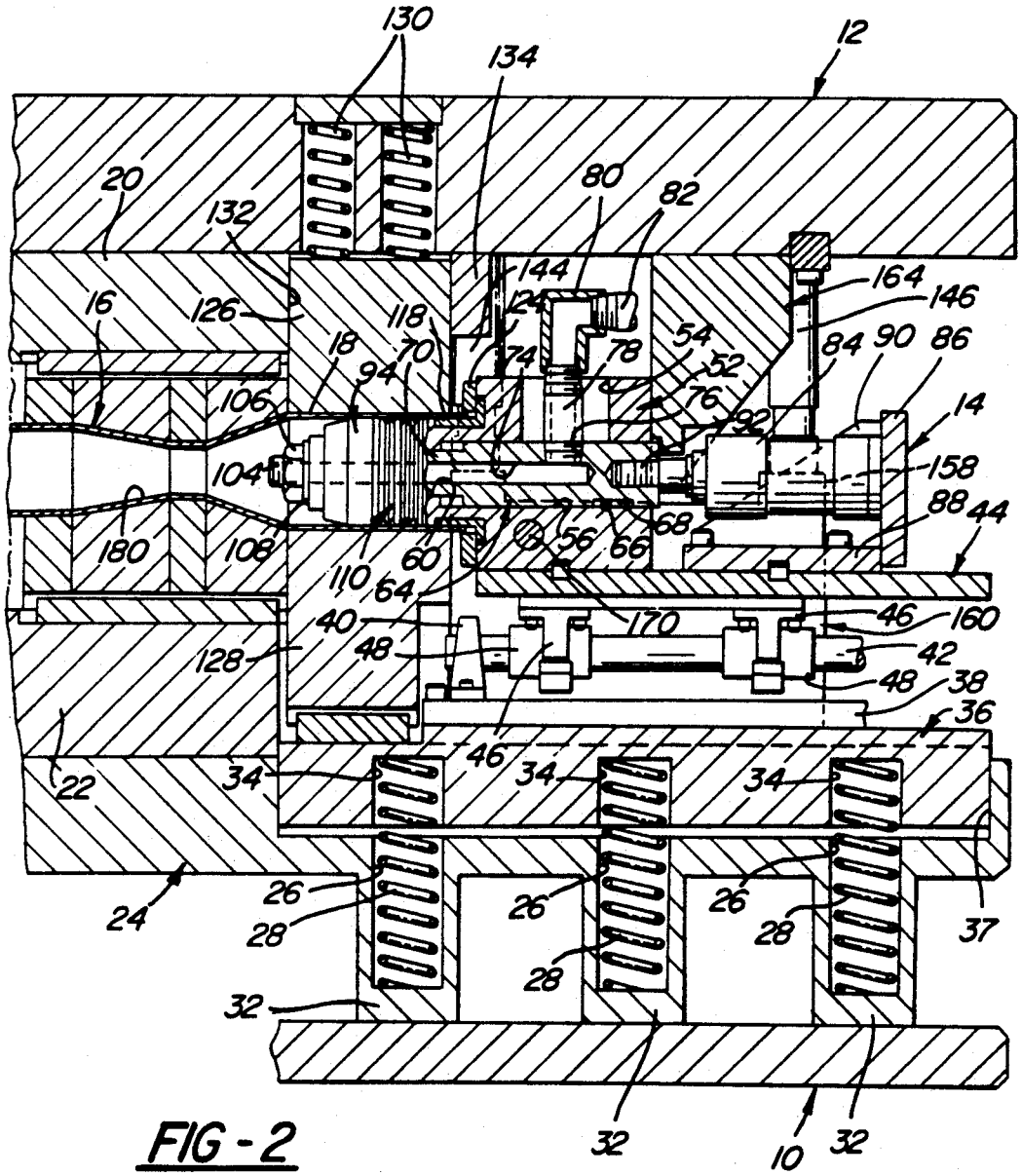
FIG. 2 is a side elevation view having parts broken away and in section showing the seal engaged with the end of the tube and the upper bed fully lowered to capture the tube between the upper and lower dies.

Referring now to FIGS. 1 and 2 of the drawings, a support plate 24 has legs 32 mounted on lower bed 10 of the press and has a series of bores 26 which receive springs 28. The upper ends of the springs 28 are seated in bores 34 of a mounting plate 36 to vertically support the mounting plate 36 within a recess 37 of support plate 24, FIG. 2. The springs 28 permit the plate 24 to move vertically as required. A second mounting plate 38 is fixed to the plate 36, such as by bolts shown in FIGS. 2 and 3 and mounts spaced pairs of stanchions 40. Each pair of stanchions mounts a guide rod 42 therebetween. A carriage plate 44 has depending aligned pairs of brackets 46 which in turn mount slides 48 to slidably mount the carriage plate 44 on the guide rods 42 for horizontal reciprocating movement. The seal unit 14 is mounted on the carriage plate 44.

Seal Construction and Operation

A block member 52 is fixed in a suitable manner to the carriage plate 44. The block member 52 includes a vertically extending slot 54 which opens to a central circular bore 56 through the block member, FIGS. 2 and 3. Bore 56 is joined across a radial shoulder 58 to a bore 60 of a cylindrical extension 62 formed integral with the block member 52.

A cylindrical member 64 is slidably mounted in the bore 56 or block member 52. A transverse pin 66 is fixed across the bore 56 and received within a peripheral chordal slot 68 of the member 64 to limit movement of the member 64 within the bore 56. The member 64 includes a reduced diameter extension 70 which is slidably received within the bore 60, with a shoulder 72 between extension 70 and the remainder of member 64 being located in opposed relationship to the shoulder 58. The member 64 and the extension 70 thereof are provided with a cylindrical bore 74. A tapped opening 76 in the member 64 receives the threaded end of a nipple 78 which is received within the slot 54. The upper end of the nipple 78 is connected to an elbow 80, FIG. 2, which is also connected to a pipe 82. The pipe 82 is connected in a conventional manner with a source of pressure fluid.

A conventional actuator 84 of the piston and cylinder type has one end thereof fixed to a plate 86. The plate 86 is secured in a vertical relationship to a plate 88 which is secured to the movable carriage plate 44 such as by bolts. Triangularly shaped side brackets 90 reinforce the plates 86 and 88 in secure relationship. The piston of actuator 84 is threadedly connected at 92 to the member 64 so as to move the member 64 and its integral extension 70 within the bores 56 and 60 of block member 52.

An outer cylindrical member 94 has an inner cylindrical bore 96 which is slidably mounted on the outer cylindrical surface of extension 62 of block member 52. The member 94 includes a radially angulated shoulder 98 which is axially opposed to a like shoulder 100 of the extension 62 of member 52. It will be noted with respect to FIG. 3 that extension 70 includes a threaded portion 102 which threadedly receives a threaded bore of the member 94 to fix the member 94 to the member 64 for movement as a unit. A threaded extension 104 of member 64 extends outwardly through the member 94 and a nut 106 and washer 108 are mounted on the extension 104 to additionally secure the member 94 to the member 64.

A bellows type seal 110 of metal includes a series of radially inwardly opening ribs 112 which successively alternate with a series of radially outwardly opening ribs 114, both set of ribs being of generally V cross-section. The alternating ribs have common legs, with the legs of the terminal ribs being radially angulated so as to seat against respective shoulders 98 and 100 of the members 94 and 52 respectively. It will be noted that these terminal legs also include axially extending flanges 115. Annular O-rings 116 are positioned within each of the ribs 112 and 114.

The open end portion 18 of the tube 16 surrounds the outer cylindrical surface of the member 94 and the outer cylindrical surface of an annular wear ring 118 which is received within peripheral grooves 120 and 122 of member 52. The wear ring 118 is secured in place by a ring 124 which is bolted to the member 52.

Figure 3:
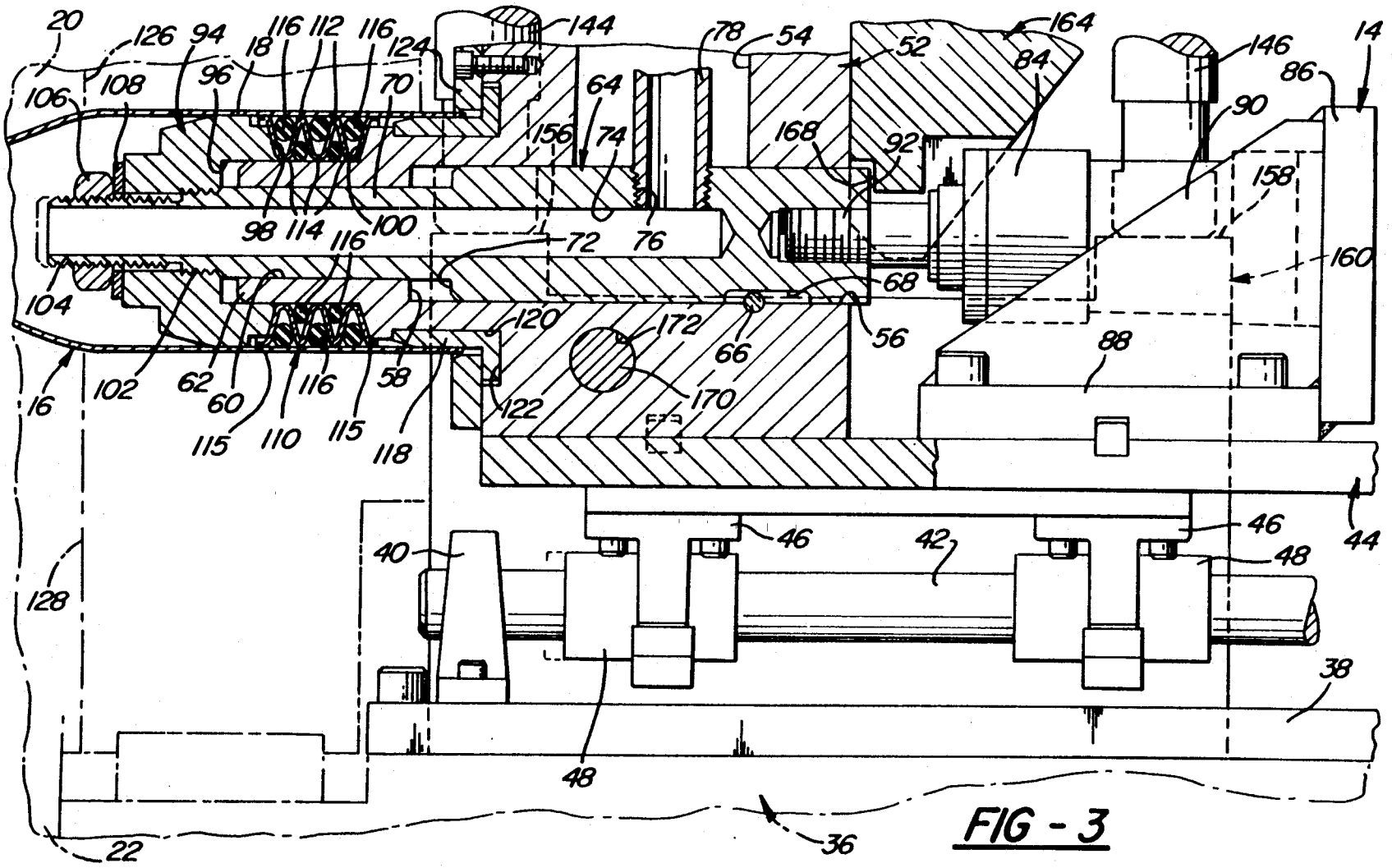
FIG. 3 shows a fragment of FIG. 2 enlarged to better show the seal unit.
Figure 4:
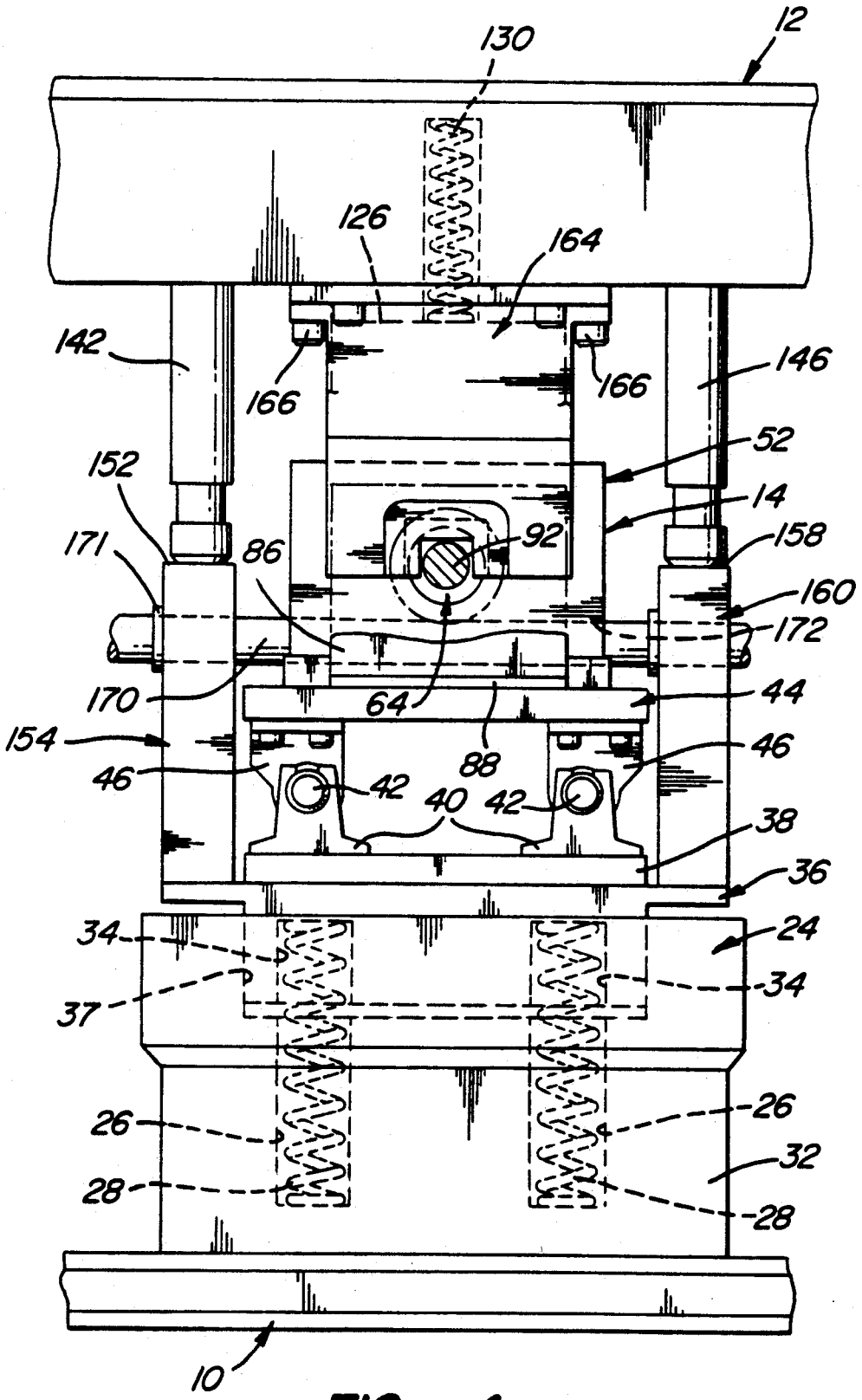
FIG. 4 is an end view of the press apparatus shown the upper bed fully lowered to close the dies about the tube.

When the open end portion 18 of the tube 16 receives the member 94 and the ring 118, as shown in FIG. 3, the bight portions of the outwardly opening ribs 114 of the bellows seal 110 engage the outer cylindrical surface of extension 62 and the bight portions of the inwardly opening ribs 112 of the bellows seal engage the inner cylindrical surface of the tube 16. Flanges 115 likewise engage the cylindrical surface of the tube 16. Thereafter the actuator 84 is energized to shift the members 64 and 94 as a unit to the right as viewed in FIGS. 2 and 3 to compress the bellows seal 110 between the shoulders 98 and 100 of the members 94 and 52 respectively. This forces the bight portions of the ribs 112 and 114 tightly against the inner surface of the tube 16 and the outer surface member 52 to effect a tight seal therebetween. The compression of the bellows seal 110 also compress the O-rings 116 between the ribs 112 and 114 to further enhance this seal. Thereafter, the pressure fluid may be released into the interior of the tube through the pipe 82, elbow 80, nipple 78, and bore 74 to force the tube to conform to the shape of the dies 20 and 22 as well as other dies, not shown, which are also mounted on the press bed 10 and the press ram 12.

It will be understood that the seal described above is only one example of seals suitable for use with the invention. Another suitable seal is shown in co-pending U.S. patent application Ser. No. G-7697, assigned to the assignee of this invention.

Tube Locating and Clamping Jaws

As seen in FIG. 2, a lower clamp 128 is fixedly mounted on the mounting plate 36 and has a circular recess therein which receives and locates the tube 16 when the tube is loaded into the opened press. The lower clamp 128 is dimensioned to support the tube 16 in alignment with the seal 94.

An upper clamp 126 is mounted on the upper bed 12 of the press above the lower clamp 128 and has a circular recess by which the upper clamp 126 will surround the tube 16 and mate with the lower clamp 128. The upper clamp 126 is mounted on the upper bed 12 by a pair of springs 130 which are normally extended to cause the upper clamp to engage with the tube 16 prior to the upper die 20 being closed with the lower die 22. The upper clamp 126 constrained against horizontal movement by its engagement with the end wall 132 of upper die 20 and a stop 134 carried by the upper bed 12.

Seal Pusher

The upper bed 12 of the press carries pusher pins 140, 142, 144 and 146. The pusher pins 140 and 142 are lowered with the upper bed 12 and engage with abutments 150 and 152 of an abutment plate 154 fixedly mounted on the mounting plate 36. Likewise, the pusher pins 144 and 146 are lowered into engagement with abutments 156 and 158 of an abutment plate 160 mounted on the mounting plate 36. Accordingly, as the upper bed 12 is lowered onto the lower bed 10 to capture the tube 16 therebetween, the pusher pins 140, 142, 144, and 146 will engage with the abutment plates 154 and 160 to ensure that the mounting plate 36 and the seal unit 14 carried thereby will be moved downwardly against the yielding of the springs 28 in a uniform manner which assures that the seal unit 14 will be maintained in proper alignment with the tube end 18.

Heel Block

Figure 5:
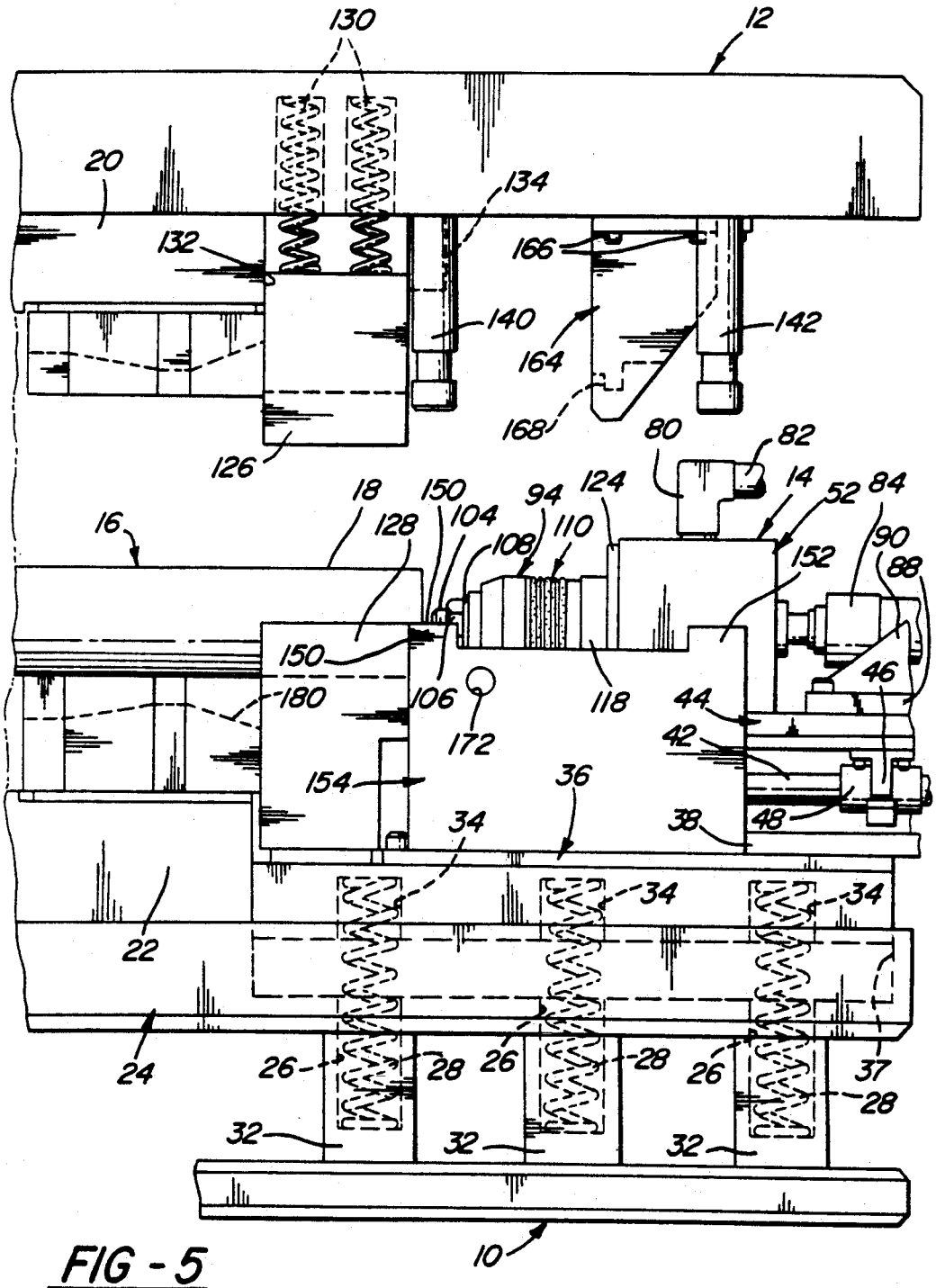
FIG. 5 is a side elevation view of the apparatus in the opened position.

A heel block 164 is attached to the upper bed 12 by a plurality of bolts 166. As best seen in FIGS. 3 and 5, the heel block 164 is lowered with the upper bed 12 so that a shoulder 168, shown in FIG. 3, will be lowered into blocking engagement with the member 64 of the seal unit. Accordingly, the heel block 164 will prevent the seal unit 14 from being disengaged from the end of the tube 16 whenever the press is closed, it being understood that the application of high fluid pressure into the tube 16 in order to hydroform the tube 16 will necessarily impose a high level of force on the heel block 164 urging the seal unit 14 to move rightwardly form the position of FIG. 3.

Locking Pins

As best seen in FIGS. 1 and 3, a locking pin 170 is inserted through a bushing 171 of the abutment plate 154 and into an aperture 172 extending crosswise through the block member 52 and through an aligned hole in the other abutment plat 160. In this manner, the locking pins locks the seal unit 14 in its position of FIGS. 2 and 3 in which the seal is engaged in the end of the tube.

A Sequence of Operation

FIG. 5 shows the press open and the seal block 52 withdrawn in the rightward direction away from the end of a tube 16 which has been loaded onto the lower clamp 128. The mounting plate 36 is biased upwardly to its FIG. 5 elevated position by the springs 28 so that the lower clamp 128 supports the tube 16 above the die surface 180 of the lower die 22. The tube 16 may be loaded into the opening between the dies by a human operator or by a robot.

The upper bed 12 is then lowered until the upper clamp 126 is brought into engagement with the tube 16 so that tube 16 is clamped between the lower clamp 128 and the upper clamp 126.

Then, the seal block 152 is slid leftwardly as permitted by leftward movement of the mounting plate 44 on the guide rods 42. Actuation of the actuator 84 of seal unit 14 then shifts the members 64 and 94 to the right as viewed in FIGS. 2 and 3 to compress the belows seal 110 outwardly to seal with the ends of the tube 16. At this point, the tube 16 can be filled with hydraulic fluid either at zero pressure or at a low pressure in the range of 0 to 1000 p.s.i.

The upper bed 12 is then fully lowered so that the pusher pins 140, 142, 144, and 146 enlarging the abutment plates 154 and 160 forcibly lower the mounting plate 36 and the seal unit 14 and the lower clamp 128 mounted thereon as the tube 16 is progressively compressed between the closing dies 20 and 22. This progressive closure of the dies is permitted by the progressive collapse of the springs 28 supporting the mounting plate 36 and the progressive compression of the springs 130 acting on the upper clamp 126. Furthermore, as the dies are closed, the heel unit at 164 is lowered into blocking engagement with the seal member 64 so that the seal unit 14 is blocked against any movement rightwardly of the FIG. 2 position.

In addition, the locking pin 170 is installed through the bushing 171 of plate 154, through aligned hole 172 of the seal block 52, and through a hole, not shown, of the abutment plate 160.

The hydraulic fluid within the tube is then subjected to the high pressure of several thousand p.s.i. in order to expand the tube 16 into the cavity defined between the dies 20 and 22. After the pressure is relieved, the press is opened, the locking pin 170 is removed, and the seal unit 14 slid rightwardly on guide rails 42 to permit the removal of the tube 16 from the press.

Thus it is seen that the invention provides a new and improved press apparatus for automating the loading and sealing of the tube within a hydroforming press.

It will be understood that a person of ordinary skill in the art may make modifications within the scope of the appended claims. For example, the use of the upper and lower clamping clamps is not essential to practice of the invention, particularly when a robot is used to position the tube within the die and hold the position of the tube while the seal unit is inserted and sealed to the end of the tube. In addition, the apparatus may be further automated by adding a hydraulic cylinder for sliding the seal unit back and forth on the guide rods 42 between the positions of FIGS. 5 and 2. Furthermore, the locking pin 170 may not be necessary if the heel block 164 is employed to block the seal unit against rightward movement.

The embodiments of the invention in which an exclusive property or privilege is claimed are defined as follows:

1. Apparatus for hydroforming a tube in a press having a movable upper bed and a fixed lower bed comprising:

an upper die mounted on the upper bed;

a lower die mounted on the lower bed and adapted to mate with the upper die upon lowering of the upper bed to define a cavity capturing the tube between the dies, said cavity having an open end through which the tube is accessible;

a mounting plate spring mounted on the lower bed adjacent the lower die to enable vertical movement of the mounting plate relative to the lower bed and the lower die;

and a seal unit mounted on the mounting plate for horizontal reciprocating movement between a retracted position withdrawn away from the tube and an engaged position in which the seal unit sealingly engages with the tube whereby upon engagement of the seal with the tube and lowering of the upper bed toward the lower bed to capture the tube between the upper and lower dies the spring mounting of the mounting plate to the lower bed enables the seal unit to move vertically to remain in sealing alignment with the tube.

2. Apparatus for hydroforming a tube in a press having a movable upper bed and a fixed lower bed comprising:

an upper die mounted on the upper bed;

a lower die mounted on the lower bed and adapted to mate with the upper die upon lowering of the upper bed to define a cavity capturing the tube between the dies, said cavity having an open end through which the tube is accessible;

a mounting plate spring mounted on the lower bed adjacent the lower die to enable vertical movement of the mounting plate relative to the lower bed and the lower die;

a seal unit movably mounted on the mounting plate for horizontal reciprocating movement between a retracted position withdrawn away from the tube and an engaged position in which the seal unit sealingly engages with the tube whereby upon engagement of the seal with the tube and lowering of the upper bed toward the lower bed to capture the tube between the upper and lower dies the spring mounting of the mounting plate to the lower bed enables the seal unit to move vertically to remain in sealing alignment with the end of the tube;

and a heel unit carried on the upper bed and being lowered with the upper bed into a position blocking the seal unit against horizontal movement in the direction away from sealing engagement with the tube.

3. Apparatus for hydroforming a tube in a press having a movable upper bed and a fixed lower bed comprising:

an upper die mounted on the upper bed;

a lower die mounted on the lower bed and adapted to mate with the upper die upon lowering of the upper bed to define a cavity capturing the tube between the dies, said cavity having an open end through which the tube is accessible;

a mounting plate spring mounted on the lower bed adjacent the lower die to enable vertical movement of the mounting plate relative to the lower bed and the lower die;

a seal unit movably mounted on the mounting plate for horizontal reciprocating movement between a retracted position withdrawn away from the tube and an engaged position in which the seal unit sealingly engages with the tube whereby upon engagement of the seal with the tube and lowering of the upper bed toward the lower bed to capture the tube between the upper and lower dies the spring mounting of the mounting plate to the lower bed enables the seal unit to move vertically to remain in sealing alignment with the tube;

and a pusher carried on the upper bed and being lowered with the upper bed to engage the seal unit upon lowering of the upper bed to push the seal unit vertically and maintain the seal in sealing alignment with the end of the tube as permitted by the spring mounted plate to maintain the seal unit in vertical alignment with the end of the tube.

4. Apparatus for hydroforming a tube in a press having a movable upper bed and a fixed lower bed comprising:

an upper die mounted on the upper bed;

a lower die mounted on the lower bed and adapted to mate with the upper die upon lowering of the upper bed to define a cavity capturing the tube between the dies, said cavity having an open end through which the tube is accessible;

a mounting plate spring mounted on the lower bed adjacent the lower die to enable vertical movement of the mounting plate relative to the lower bed and the lower die;

a seal unit movably mounted on the mounting plate for horizontal reciprocating movement between a retracted position withdrawn away from the tube and an engaged position in which the seal unit sealingly engages with the tube whereby upon engagement of the seal with the tube and lowering of the upper bed toward the lower bed to capture the tube between the upper and lower dies the spring mounting of the mounting plate to the lower bed enables the seal unit to move vertically to remain in sealing alignment with the end of the tube;

a pusher carried on the upper bed and being lowered with the upper bed to engage the seal unit upon lowering of the upper bed to push the seal unit vertically and maintain the seal in sealing alignment with the end of the tube as permitted by the spring mounted mounted plate to maintain the seal unit in vertical alignment with the tube;

and a heel unit carried on the upper bed and being lowered with the upper bed into a position blocking the seal unit against horizontal movement in the direction away from sealing engagement with the tube.

5. Apparatus for hydroforming a tube in a press having an upper bed and a lower bed comprising:

an upper die mounted on the upper bed;

a lower die mounted on the lower bed;

a mounting plate spring mounted on the lower bed adjacent the lower die to enable vertical movement of the mounting plate between elevated and lowered positions relative to the lower bed and the lower die;

a seal unit movably mounted on the mounting plate for horizontal reciprocating movement between a retracted position withdrawn away from the tube and an engaged position in which the seal unit sealingly engages with the tube;

a lower clamp mounted on the spring mounted mounting plate and adapted to suspend the tube above the lower die when the mounting plate is established at the elevated position;

and an upper clamp spring mounted on the upper bed above the lower clamp to enable vertical movement of the upper clamp relative to the upper bed whereby lowering of the upper bed toward the lower bed carries the upper clamp into engagement with the tube and the lower clamp to tightly grip the tube between the upper and lower clamps, and whereby upon further lowering of the upper bed the spring mounting of the upper clamp to the upper bed and the spring mounting of the mounting plate to the lower bed enable full closure of the upper and lower dies about the tube while the seal unit is permitted to remain in sealing alignment with the tube.

* * * * *